United States Patent [19]

Werner

[11] 3,961,746

[45] June 8, 1976

[54] CENTRIFUGE WITH A DEVICE FOR BLOCKING AND UNBLOCKING AN OPENING THEREOF

[75] Inventor: Wolfgang Werner, Braunschweig, Germany

[73] Assignee: Salzgitter Maschinen Aktiengesellschaft, Salzgitter, Germany

[22] Filed: June 28, 1974

[21] Appl. No.: 484,325

[30] Foreign Application Priority Data

June 29, 1973 Germany ..... 2333122

[52] U.S. Cl. ..... 233/20 R; 233/46; 251/61.2; 210/359

[51] Int. Cl.[2] ..... B04B 11/05

[58] Field of Search ..... 233/20 R, 21, 22, 27, 233/28, 46, 47 R, 1 R; 251/61.2, 61.3, 61.5; 210/359

[56] References Cited

UNITED STATES PATENTS

| | | | |
|---|---|---|---|
| 2,919,102 | 12/1959 | Peters | 251/61.2 |
| 3,056,505 | 10/1962 | Andersson | 233/27 X |
| 3,219,310 | 11/1965 | Baumann | 251/61.5 |
| 3,294,317 | 12/1966 | Moretti | 233/20 R |
| 3,530,770 | 9/1970 | McMurry | 251/61.2 |
| 3,637,187 | 1/1972 | Burger | 251/61.3 |
| 3,655,124 | 4/1972 | Sommer | 233/46 |
| 3,773,253 | 11/1973 | Laven | 233/20 R |

*Primary Examiner*—George H. Krizmanich
*Attorney, Agent, or Firm*—Michael J. Striker

[57] ABSTRACT

A centrifuge drum is mounted for rotation about an upright axis and has a bottom wall provided with an opening. A closure member is mounted for movement relative to the bottom wall between a first position in which it sealingly blocks the opening, and a second position in which it unblocks the opening. A fluid-pressure actuated arrangement is operable to move the closure member to its first position and maintain it there as long as desired. A connecting head is provided which connects the fluid pressure-actuated arrangement with a source of pressure fluid.

17 Claims, 11 Drawing Figures

CENTRIFUGE WITH A DEVICE FOR BLOCKING AND UNBLOCKING AN OPENING THEREOF

BACKGROUND OF THE INVENTION

The present invention relates generally to a centrifuge, and more particularly to a centrifuge having an arrangement for blocking and unblocking an opening of the centrifuge drum.

Centrifuges, particularly sugar centrifuges, are known wherein the centrifuge drum is mounted for rotation about an upright axis and has a bottom wall that is provided with an opening. German Auslegeschrift No. 1,062,632 discloses such an arrangement wherein a closure member is provided that is slidably mounted on a hub portion that extends out through the outlet opening in the bottom wall of the centrifuge drum. A spring urges the closure member out of engagement with the bottom wall, so that the opening will be unblocked, and a fluid operated cylinder unit acts via a linkage arrangement upon the closure member and serves, when operated, to move the latter into engagement with the bottom wall to block the opening.

I have found that it is desirable to further improve upon this type of construction, because this prior-art construction is relatively complicated and expensive, and of course requires a relatively large amount of room. Moreover, it is not possible always to be certain that the opening is completely sealed against the escape of matter from the same.

SUMMARY OF THE INVENTION

Accordingly, it is a general object of the invention to provide an improved centrifuge construction which avoids the aforementioned disadvantages.

An additional object is to provide such an improved centrifuge construction which reliably seals the opening in the bottom wall of the centrifuge drum, and which is relatively inexpensive and requires little space.

In keeping with these objects, and with others which will become apparent hereafter, one feature of the invention resides in a centrifuge, particularly a sugar centrifuge, having a centrifuge drum that is mounted for rotation about an upright axis and having a bottom wall provided with an opening. A closure member is mounted for movement relative to the bottom wall between a first position in which it sealingly blocks the opening, and a second position in which it unblocks the opening. Pressure fluid actuated means is operable for moving the closure member to the first position and for maintaining it there for as long as desired. Connecting means serves to connect the fluid pressure actuated means with a source of pressure fluid.

It is highly desirable that the fluid pressure actuated means be at least in part constituted of inflatable and elastically extendable and collapsible bellows members, of the type for instance which is disclosed for other purposes in a publication entitled "Continental Luftfederbaelge", 1968, issued by Continental Gummiwerke AG in Hannover, Germany. Such bellows members or elements have manifold advantages, including the fact that they require little space for installation, have a high life expectancy and are extremely reliable in operation.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
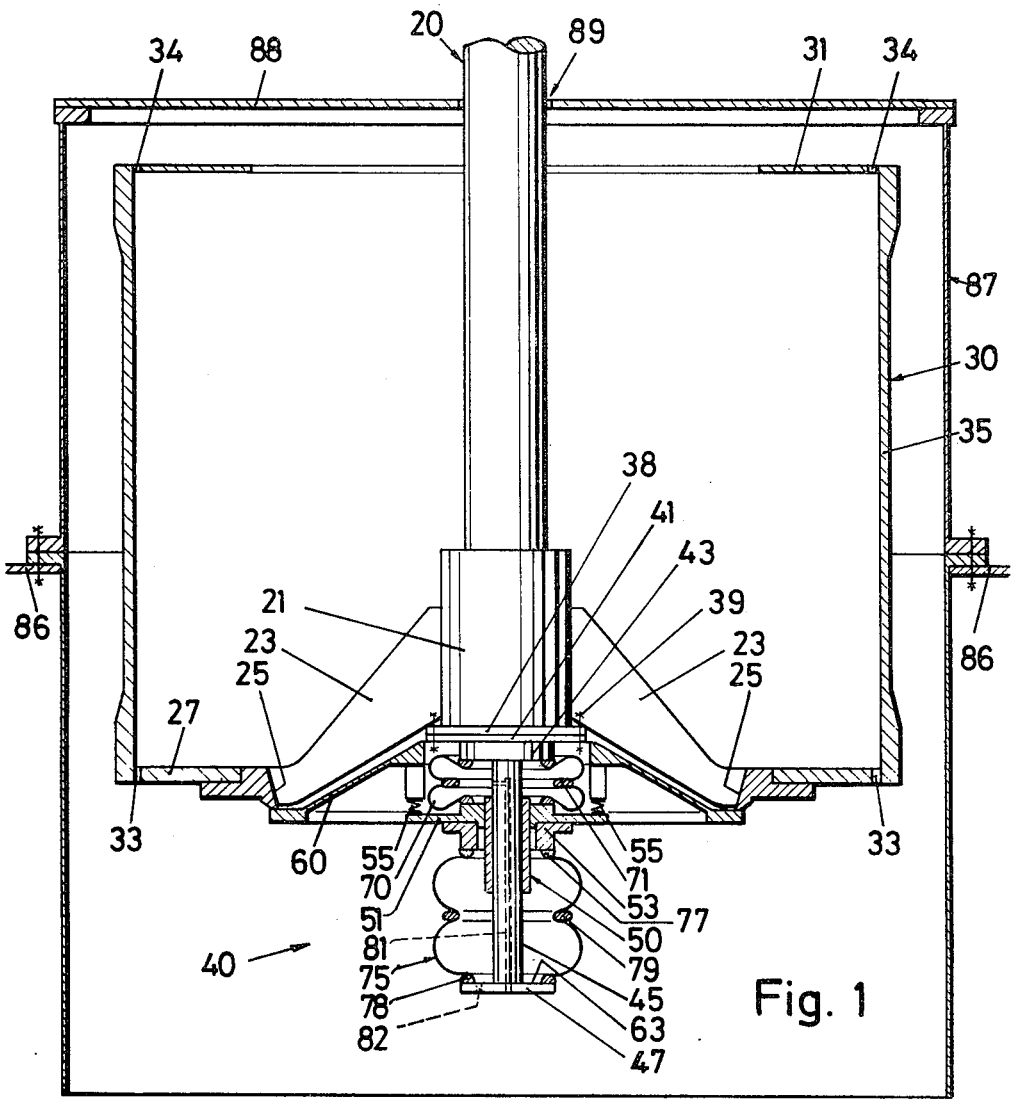
FIG. 1 is a diagrammatic vertical section through a centrifuge incorporating a first embodiment of the invention, showing the closure member in closed condition.
Figure 2:
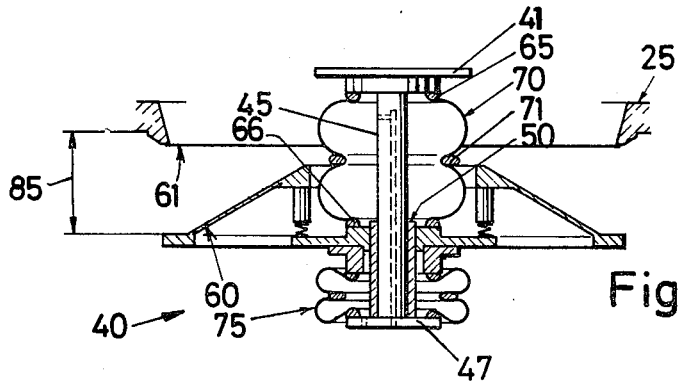
FIG. 2 is fragmentary detail view of FIG. 1, showing the closure member in open position.
Figure 3:
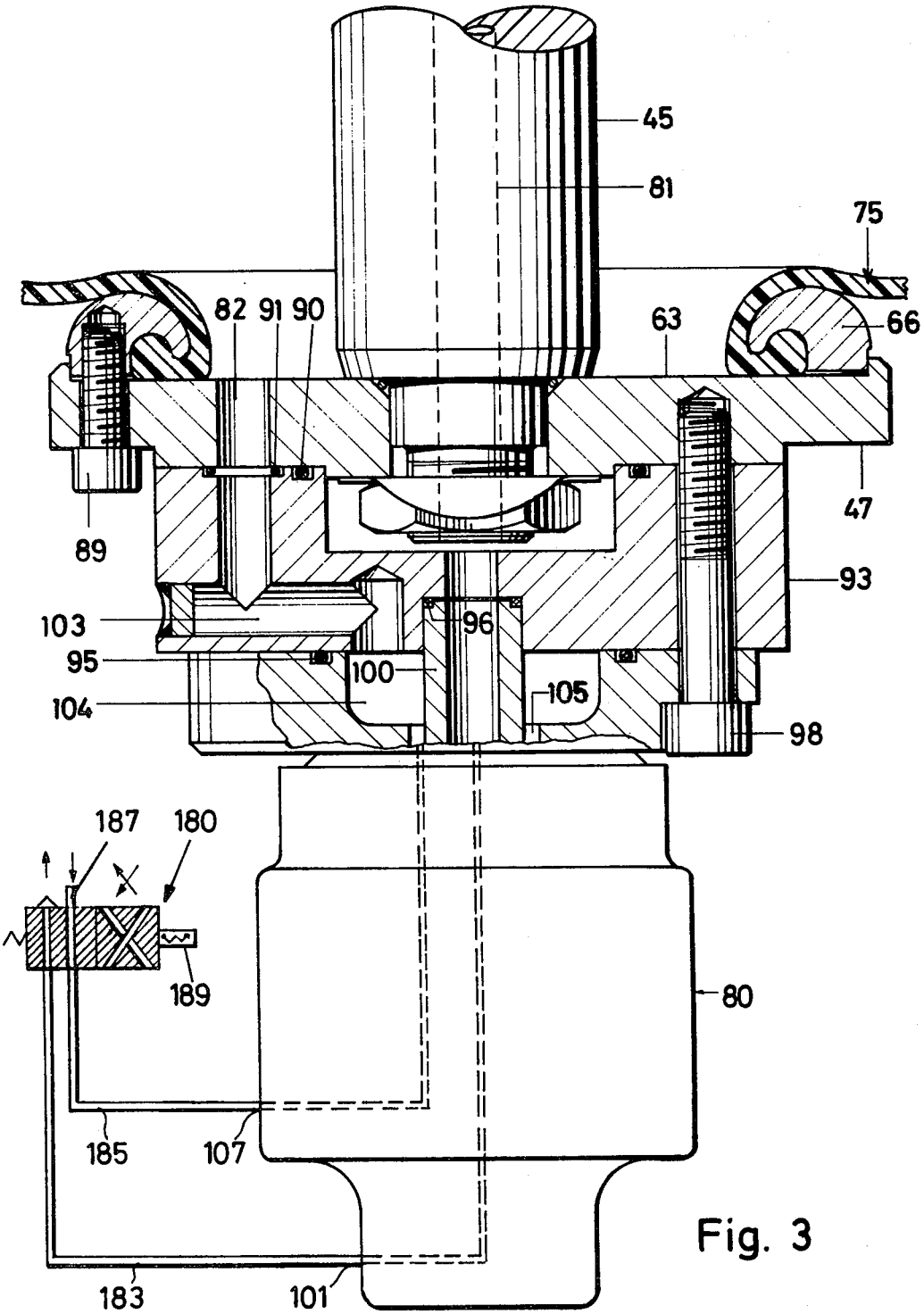
FIG. 3 is an enlarged sectioned detail view of FIGS. 1 and 2.

Referring firstly to the embodiment in FIGS. 1–3, it will be seen that reference numeral 20 identifies an upright centrifuge shaft which is suspended in conventional and therefore not illustrated manner. The lower end of the shaft 20 has a hub 21 which is provided with a plurality of circumferentially distributed arms 23 which are fixedly connected with a flange 25 on the bottom wall 27 of a centrifuge drum 30. The bottom wall 27 has a bottom outlet opening 61, as shown in FIG. 1. The drum additionally has a top wall or cover 31. The bottom wall 27 is provided with a plurality of outlet openings 33 through which sugar syrup escapes, assuming that the centrifuge is used in the sugar production. Similar outlet openings are provided for the same purpose in the cover 31 and are identified with reference numeral 34. The circumferential wall of the drum is identified with reference numeral 35 and is not perforated; in conventional manner such a wall will have disposed on its inner circumferential surface a screen member (not illustrated) on the inwardly directed surface of which the separated sugar crystals will accumulate. A flange 38 is provided at the lower end of the hub 21, and a closure unit which is designated in toto with reference numeral 40, is connected from below to the flange 38 via a flange 41 and with the aid of screws or bolts 39.

The flange 41 is provided with an end member 43 that is located coaxially with reference to the shaft 20, and also with a guide rod 45 the free lower end of which is provided with a base plate 47 an upwardly directed surface 63 of which constitutes an abutment, as will be explained later.

A sleeve 50 surrounds and is axially slidable on the guide rod 45; it has at its upper end a flange 51 to which a ring 53 is threadedly connected at the underside. The upper side of the flange 51 engages via interposed springs 55 a closure member 60 which is to be able to move into and out of a position in which it blocks or unblocks the bottom outlet opening 61 of the drum 30. The upper surface 63 of the end plate 47 constitutes an abutment for the lower end of the sleeve 50.

A fluid pressure actuated arrangement for effecting movement of the closure member 60 uses in this embodiment a pair of inflatable and resiliently expandable and collapsible bellows elements 70 and 75. One of these bellows elements, namely the one identified with reference numeral 70, is secured to the underside of the end member 43 and to the upper side of the flange 51 with respective end rings 65 and 66 of metallic material. The connection is such that it is air tight. The bellows member 70 is of the type that is constricted intermediate its opposite ends, a metallic ring 71 being located in this constriction as shown in the drawing. The bellows member 75 is connected to the underside of the ring 53 and to the upper side of the end plate or base plate 47 with its opposite axial ends, again by means of metallic rings 77 and 78. Here, also, the connection is air tight. The bellows member 75 is also provided with a central constriction in which a metallic ring 79 is located.

A connecting head 80 is mounted on the underside of the end plate 47, as shown more clearly in FIG. 3. The purpose of the connecting head 80 is to make it possible to selectively supply compressed air or other compressed fluid from the exterior of the centrifuge to the bellows element 70 via the passage 81 in the guide rod 45, or to supply such compressed gas to the bellows element 75 via a conduit 82 in the end plate 47. The connecting head 80 does not form part of the invention. Such connecting heads are, for instance, known from the advertising brochure "Airflex RS 9040" concerning operation, installation, and maintenance of the Airflex AD, BD, and FDA rotorseals, edited by the firm Binder Magnete GmbH in D 7730 Villingen-Schwenningen, Moenchweilerstrasse 1, West Germany, with information to be obtained from Eaton Corporation, Industrial Drives Division, 9919 Clinton Road, Cleveland, Ohio 44111.

If air is supplied to the bellows member 75 as shown in FIG. 1, then the axial expansion of the bellows member 75 will cause the sleeve and hence the closure member 60 to be shifted upwardly along the guide rod 45 until the closure member 60 is in tight engagement with the bottom wall 27 of the drum, sealing the outlet opening 61 thereof. At this time, the interior of the bellows member 70 is vented via the passage 81.

When it is desired to open the outlet opening 61, then compressed air is admitted into the bellows member 70 and at the same time the bellows member 75 is vented via the passage 82. This causes the sleeve 50 and the closure member 60 to move downwardly until the lower end of the sleeve 50 engages the abutment 63, which takes place at the time at which the closure member 60 has travelled through its maximum stroke 85 in direction away from the bottom wall 27, thus unblocking the opening 61. If the centrifuge is a centrifuge used in the sugar production, the accumulated sugar in the centrifuge will in this condition be discharged through the opening 61 in known manner.

The drum 70 is surrounded by a housing 87 which is mounted on the centrifuge support 86 and is closed at its upper end with a cover 88 which is sealed by a seal 89 with reference to the shaft 20. The housing 87 is stationary and serves to intercept the syrup which issues during rotation of the drum 30 from the openings 33, 34. It is not necessary to discuss in detail how the syrup is conducted out of the housing 87, because this is well known and in any case is not a part of the present invention.

The bellows members 70 and 75 are advantageously of neoprene rubber, which has excellent resistance to deterioration both due to atmospheric conditions and to contact with oil. FIG. 3 shows that they are pressed by the respective metal rings, such as the ring 66 that is visible in FIG. 3, into air-tight engagement with the respectively cooperated sealing surface, for which purpose the screws or bolts 89 are provided. A connecting member 93 is secured to the underside of the base plate 47, being sealed with respect thereto by means of O-rings 90 and 91, and secured to the underside of the connecting member 93, again sealed by means of O-rings 95 and 96, is the connecting head 80. The connecting head 80 and the connecting member 93 are secured to one another by means of screws 98 and also mounted on the base plate 47.

The conduit or passage 81 is in communication via a tube 100 with the schematically illustrated connector 101 of the non-rotatable portion of the head 80, through which air under pressure can be admitted. The conduit 82 is similarly connected with the diagrammatically illustrated connector 107 for air, via a passage 103, 104 and 105. The connectors 101 and 107 in turn are controlled via one of the control devices known in the art, so that at appropriate times in the operation of the centrifuge air is admitted into them or the admission of air is terminated. In FIG. 3 the connectors 101 and 107 are connected to a four way / two position valve 180 by means of conduits 183 and 185, respectively. Air under pressure is supplied to the valve 180 through a feed line 187. The valve 180 is controlled at the appropriate times by energization of its solenoid 189 through said control device. Evidently, the connectors 101 and 107 could instead be connected to different valves, for instance to a two way / two position valve each (not shown).

Figure 4:
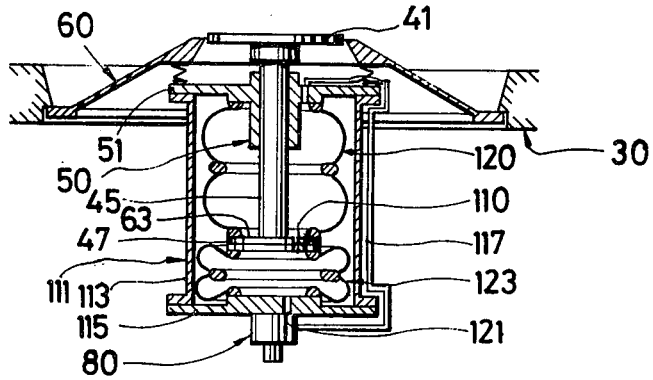
FIG. 4 is a view analogous to FIG. 2, but illustrating a further embodiment of the invention with a closure member in closing position.
Figure 5:
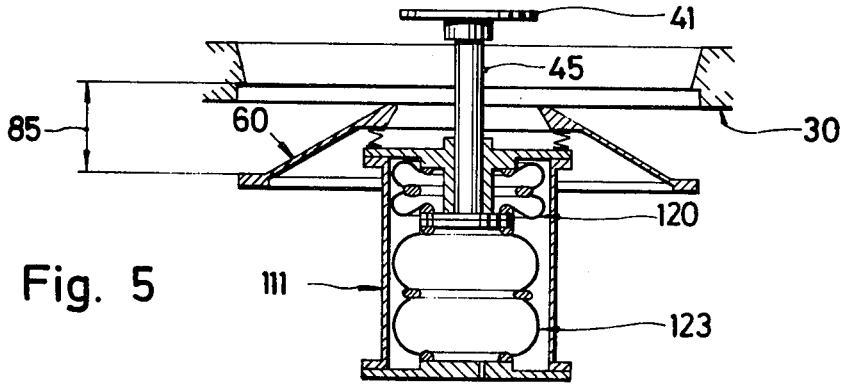
FIG. 5 is a view similar to FIG. 4, showing the closure member of FIG. 4 in open position.

A further embodiment of the invention is illustrated in FIGS. 4 and 5 and in this embodiment, as in all others, like reference numerals identify like elements as in FIGS. 1–3. In FIGS. 4 and 5 a plate 110 is screw connected to the underside of the base plate 47, and a cup-shaped yoke 111 is screw connected to the underside of the flange 51. The bottom wall 115 of the yoke 111 has secured to it the head 80 which communicated via a conduit 117 with the interior of a bellows element 120, and via a conduit 121 with the interior of a bellows element 123. The bellows element 120 is located between the flange 51 and the base plate 47, and the bellows element 123 between the plate 110 and the bottom wall 115. The purpose and operation of the bellows elements 120, 123 is the same as in the embodiment of FIGS. 1–3.

Figure 6:
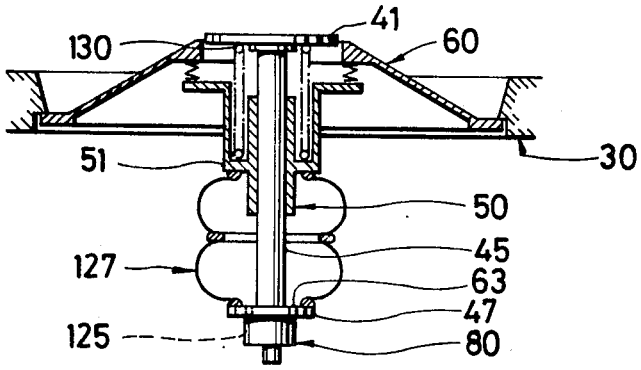
FIG. 6 is a view similar to FIG. 4, illustrating a further embodiment with the closure member in closed position.
Figure 7:
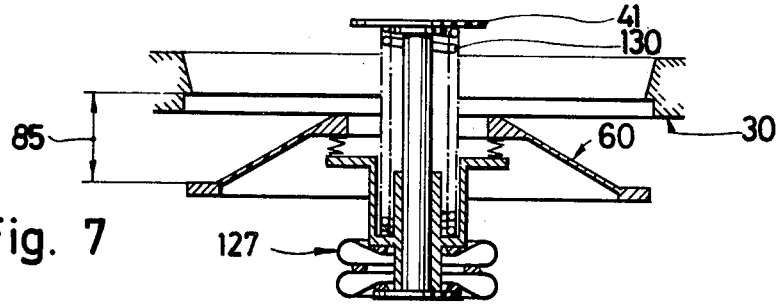
FIG. 7 shows the embodiment of FIG. 6 with the closure member in open position.

FIGS. 6 and 7 illustrate an embodiment in which the head 80 is again mounted at the underside of the base plate 47, and communicates via a conduit 125 with the interior of a bellows element 127 which is mounted intermediate the base plate 47 and the flange 51. The latter has a cup-shaped upwardly projecting extension in which the lower end of a helical expansion spring 130 is received. The upper end of this spring engages the underside of the flange 41. When air is admitted into the bellows element 127, the latter shifts the closure member 60 upwardly to seal the opening 61, and when air pressure is subsequently released, then the restoring spring 130 displaces the closure member 60 from the closed position shown in FIG. 6 into the open position shown in FIG. 7, at the same time expelling air from the bellows element 127 as it causes the same to become collapsed.

Figure 8:
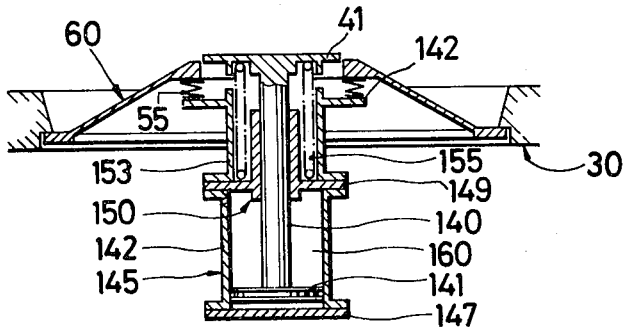
FIG. 8 is a view similar to FIG. 6, showing the closure member in closed position in still an additional embodiment of the invention.
Figure 9:
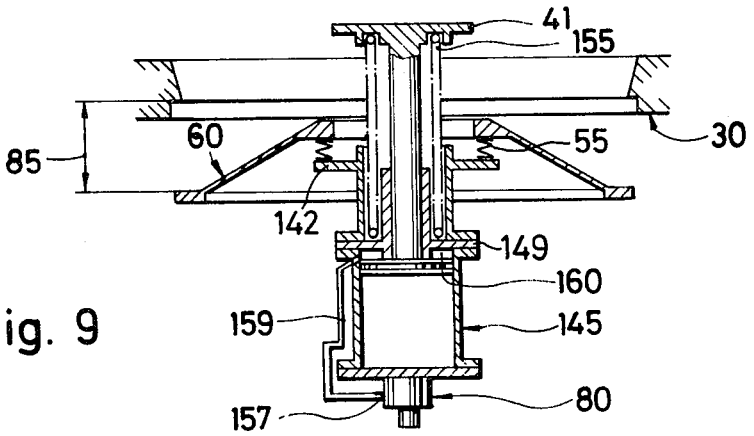
FIG. 9 shows the closure member of the embodiment of FIG. 8 in open position.

The embodiment in FIGS. 8 and 9 has a piston rod 140 mounted on the flange 41 and carrying at its free end a piston 141. The latter is slidably accommodated in a cylinder 145 which is closed at the lower end by a bottom wall 147. and at the upper end by a flange 149 which is formed or otherwise provided on a sleeve 150 which slidably surrounds the piston rod 140. The upwardly directed side of the piston 141 serves as an abutment for the sleeve 150 when the latter moves to the unblocking position shown in FIG. 9. A sleeve 153 is mounted on the upper side of the flange 149 and surrounds the sleeve 150 with radial spacing. Its flange 142 is connected via the springs 55 with the closure member 60. A helical expansion spring 155 is located in the clearance between the sleeves 150 and 153, having a lower end which engages the flange 149 and an upper end which engages the flange 41. In analogy to the embodiment in FIGS. 6 and 7, the head 80 in this embodiment of FIGS. 8 and 9 has an outlet 157 which is connected via a conduit 159 with the cylinder space or chamber 160 that is located at that side of the piston which has the smaller surface area. In other words, the cylinder 145 in the embodiment of FIGS. 8 and 9 is a single-acting cylinder which serves only to move the closure member 60 to closing position, whereas the restoration of the closure member to open position takes place when fluid pressure application to the cylinder 145 is terminated and the restoring spring 155 can effect shifting of the closure member 60 to its open position that is shown in FIG. 9.

Figure 10:
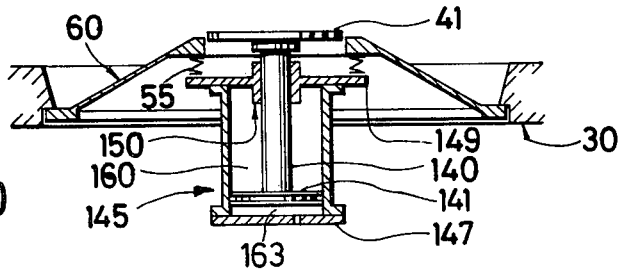
FIG. 10 is a view similar to FIG. 8, showing yet a further embodiment of the invention with the closure member in closed position.
Figure 11:
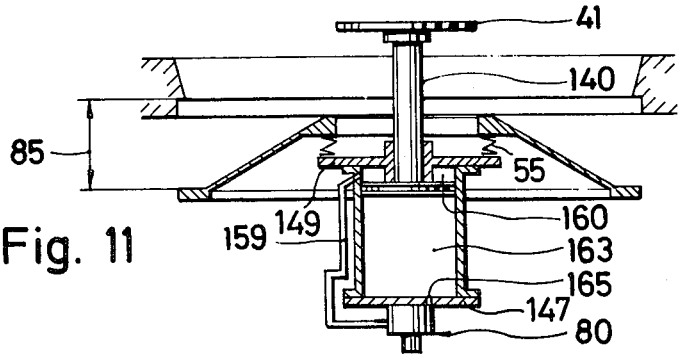
FIG. 11 shows the embodiment of FIG. 10 with the closure member in open position.

Coming, finally, to the embodiment in FIGS. 10 and 11 it will be seen that this is reminiscent of the one in FIGS. 8 and 9, but uses a double-acting cylinder. The springs 55 are in direct engagement with the flange 149 of the sleeve 150 in this embodiment. The restoration of the closure member 60 from its closed position in FIG. 10 to the open position in FIG. 11 is the result not of a spring, such as the spring 155 of FIGS. 8 and 9, but of the fact that the cylinder in this embodiment is of double-acting type, having in addition to the cylinder chamber 160 a further cylinder chamber 163 which is adjacent that side of the piston that has the larger surface area. When fluid is admitted from the head 80 via the conduit 159 into the cylinder chamber or space 160, the closure member 60 moves to the closed position shown in FIG. 10. When it is desired to open the member 60 so that it will move to the position shown in FIG. 11, then fluid is admitted via the head 80 and a further conduit 165 which passes through the bottom wall 147 of the cylinder 145, into the chamber 163. The result is a movement of the closure member 60 to the position in FIG. 11.

The use of the bellows elements in FIGS. 1–7 has the advantage that relatively small masses need be accelerated when the closure member 60 is moved between its open and closed positions. If desired, for instance if there might be a danger of possible damage to the bellows elements, the sleeve, such as the sleeve 50 in FIG. 1, can be appropriately secured against turning relative to the guide rod 45. The particular embodiment of FIG. 1 has the advantage that the opposite axial ends of the sleeve 50 are each located within one of the bellows elements 70, 75, and are thus protected against contact with sugar dust or any other substances that might have a deleterious effect upon them. The air that is supplied into the bellows elements in the several embodiments may have an oil mist or other lubricant added to it, so as to provide for lubrication of the glide faces which are in contact.

The embodiment in FIGS. 4 and 5, wherein both of the bellows elements 120, 123 are located in the cup-shaped yoke 111, has the advantage that the bellows elements are protected against deleterious influences such as contact with sugar dust or the like. The exposed arrangements shown in FIGS. 1–3 and 6–7, on the other hand, have the advantage that the respective bellows members are readily accessible for inspection and replacement.

It will be appreciated that in the embodiments of FIGS. 6–7 and 8–9 the respective restoring springs that are used to effect movement of the closure member 60 from closed to open position, need not be helical springs as illustrated, but could be other springs, for instance a spring composed of a packet of dished or Bellville springs. The bellows members that are utilized in the embodiments of FIGS. 1–7 need not be of the centrally constricted type, although this has been found to be advantageous, but could be of any other type that can be employed in the invention. The fact that the closure member 60 is supported on the flange 51 via the interposed springs 55, or in some other way which permits a self-adjustment of the closure member 60 with reference to the flange 25 of the bottom wall 27, has the advantage that a particularly advantageous and reliable sealing contact can be established between the closure member 60 and the flange 25, because the closure member 60 can then engage the seating surface bounding the opening 61 in the most uniform possible manner.

It will be understood that each of the elements described above, or two or more together, may also find a useful application in other types of constructions differing from the types described above.

While the invention has been illustrated and described as embodied in a sugar centrifuge, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. In a centrifuge, particularly a sugar centrifuge, a combination comprising a centrifuge drum mounted for rotation about an upright axis and having a bottom wall provided with an opening; a closure member mounted for movement relative to said bottom wall between a first position in which it sealingly blocks said opening, and a second position in which it unblocks said opening; a guide rod projecting axially of said drum from said bottom wall; a sleeve slidably surrounding said guide rod axially adjacent said closure member; coupling means coupling said sleeve with said closure member for joint movement therewith; an expansible and collapsible bellows element cooperating with said sleeve to effect, when inflated, sliding of said sleeve along said guide rod until said closure member is in said first position; and connecting means for connecting said bellows element with the source of pressure fluid.

2. A combination as defined in claim 1, wherein said bellows element engages said sleeve and effects sliding of the latter relative to said rod in direction towards said bottom wall; and further comprising restoring means for restoring said closure member to said second position in direction away from said bottom wall.

3. A combination as defined in claim 2, wherein said restoring means comprises an additional expansible bellows element which also acts upon said sleeve and is inflatable to effect sliding of said sleeve in direction away from said bottom wall.

4. A combination as defined in claim 3, wherein each of said bellows elements has spaced axial ends and single a circumferential constriction intermediate said axial ends.

5. A combination as defined in claim 3, wherein said rod has a free end portion; and wherein said connecting means comprises a connecting head coupled with said free end portion and including fluid conduits which communicate with the respective bellows element.

6. A combination as defined in claim 4, wherein each of said bellows elements are formed from neoprene rubber, and including a metallic ring located in said constriction.

7. A combination as defined in claim 3, wherein said guide rod has a free end remote from said bottom wall and provided with a base plate, and wherein said connecting means comprises a connecting head coaxial with said guide rod, a connecting member coaxially fixed to said base plate between the latter and said connecting head, first passage means extending through said connecting head, said connecting member and said guide rod and communicating with the interior of said additional bellows element, and second passage means extending through said connecting head, said connecting member and said base plate and communicating with the interior of said bellows element, and valve means for selectively connecting said first and second passage means to a source of pressure fluid.

8. A combination as defined in claim 2, wherein said restoring means comprises a restoring spring acting upon said sleeve and permanently tending to slide the same along said guide rod in direction away from said bottom wall.

9. A combination as defined in claim 2, wherein said guide rod has a free end remote from said bottom wall and provided with an abutment; and wherein said bellows element has opposite end portions which respectively bear upon said abutment and said sleeve.

10. A combination as defined in claim 9, wherein said sleeve comprises an outwardly extending yoke portion, and wherein said bellows element bears upon said yoke portion.

11. A combination as defined in claim 10, wherein said yoke portion is cup-shaped and surrounds said sleeve; said bellows element being located in said yoke portion.

12. A combination as defined in claim 9, wherein said sleeve comprises an outwardly extending yoke portion, and wherein said bellows element bears upon said yoke portion for urging said said sleeve towards said bottom wall; and wherein said restoring means comprises an additional bellows element which also bears upon said yoke portion but for urging said sleeve away from said bottom wall.

13. A combination as defined in claim 12, wherein said yoke portion is substantially cup-shaped and surrounds said sleeve; and wherein both of said bellows elements are received in said yoke portion.

14. A combination as defined in claim 12, wherein said connecting means comprises a connecting head coupled with said yoke portion and including a first fluid conduit which communicates with the first-mentioned bellows element, and a second fluid conduit which communicates with said additional bellows element and passes through said yoke portion.

15. A combination as defined in claim 2; and further comprising abutment means on said rod for limiting the sliding of said sleeve in direction away from said bottom wall.

16. A combination as defined in claim 1, wherein said coupling means comprises coupling members which couple said sleeve and said closure member for relative resilient displacement.

17. A combination as defined in claim 16, wherein said coupling members are spring members which are stressed between said sleeve and said closure member.

* * * * *

UNITED STATES PATENT AND TRADEMARK OFFICE

Certificate

Patent No. 3,961,746

Patented June 8, 1976

Wolfgang Werner

Application having been made by Wolfgang Werner, the inventor named in the patent above identified, and Salzgitter-Maschinen Aktiengesellschaft, Salzgitter-Bad, Germany, the assignee, for the issuance of a certificate under the provisions of Title 35, Section 256, of the United States Code, adding the name of Kurt Buge as a joint inventor, and a showing and proof of facts satisfying the requirements of the said section having been submitted, it is this 13th day of September 1977, certified that the name of the said Kurt Buge is hereby added to the said patent as a joint inventor with the said Wolfgang Werner.

FRED W. SHERLING,
*Associate Solicitor.*